US005296832A

United States Patent [19]

Perreault et al.

[11] Patent Number: 5,296,832

[45] Date of Patent: Mar. 22, 1994

[54] CURRENT LIMITING FUSE

[75] Inventors: Richard J. Perreault, Amesbury, Mass.; Robert M. Pimpis, Dover, N.H.

[73] Assignee: Gould Inc., Eastlake, Ohio

[21] Appl. No.: 52,388

[22] Filed: Apr. 23, 1993

[51] Int. Cl.[5] ..... H01H 85/04; H01H 85/143

[52] U.S. Cl. ..... 337/158; 337/201; 337/251; 337/252

[58] Field of Search ..... 337/251, 252, 253, 254, 337/158, 227, 228, 201, 213

[56] References Cited

U.S. PATENT DOCUMENTS 973,250 10/1910 Barricklow .

2,769,059 10/1956 Baenziger ..... 337/251

*Primary Examiner*—Harold Broome

*Attorney, Agent, or Firm*—Fish & Richardson

[57] ABSTRACT

A fuse that includes a tubular member made from insulative material, end block portions made from insulative material, a spanner joining together the end block portions, terminals extending through openings in the end block portions, and a fusible element having ends connected to both of the terminals. Each of the terminals has an internal portion inside the tubular member to which a fusible element is attached, an external portion outside of the tubular member, and a middle portion between the internal and external portions and located within one of the openings of the end block portions.

32 Claims, 2 Drawing Sheets

CURRENT LIMITING FUSE

BACKGROUND OF THE INVENTION

The invention relates to current limiting fuses.

Current limiting fuses typically have one or more fusible elements connecting two conducting terminals within an insulative housing.

One type of fuse construction employs a housing made of a tubular casing of melamine glass, cardboard, or thermoset polymer resins in a matrix with glass or papers. The ends of the tubes are typically closed with end caps, which go around the ends of the tube, or end blocks of brass or copper, which are inside of the tube at the ends. When end blocks are employed, there often are terminal blades that are located on the outer surfaces of the end blocks (being either integral with or attached such as by welding or brazing to the end blocks), and fusible elements are connected, e.g., by welding in grooves, to the inside surfaces of the end blocks.

Barricklow U.S. Pat. No. 973,250 describes a different type of fuse construction in which the insulative housing is made of two pieces that are bolted together.

SUMMARY OF THE INVENTION

In one aspect, the invention features, in general, a fuse which includes a tubular member made of insulative material and having two open ends, two end block portions made of insulative material and located at each end of the tubular member, and a spanner joining together the end block portions inside of the tubular member. Terminals extend through openings in the end block portions, and a fusible element located inside the tubular member has ends connected to each of the terminals. The spanner provides structural integrity to the fuse, facilitates modular assembly, and accurately spaces end block portions from each other.

In preferred embodiments, a second spanner can be provided to increase the strength of the end block/spanner assembly. The end block portions and the spanner can comprise a single housing piece that is made of plastic; this approach permits reducing the number of parts and simplifies the assembly and manufacture procedure. Alternatively, the end block portions and the spanner can comprise separate pieces that have been connected together. The spanners can be made of metal.

The tubular member is cylindrical and the end block portions are circular. The outside surface of the spanner abuts the inside surface of the tubular member, holding the spanner in place during assembly and increasing the strength of the completed fuse. The terminals can be insert molded in the end block, or other techniques can be used to retain the terminals in the end block portions. For enduring retention, the terminals are ultrasonically welded to the end block portions. Likewise, the tubular member and the end block portions can be ultrasonically welded to each other.

In one embodiment, one open end of the tubular member has a lip that makes the open area of that open end smaller than the open area of the other open end. One of the end block portions has two sections sized so that one of the sections fits in the open area defined by the lip and the other section is larger than the open area defined by the lip. This allows that end block portion to be inserted through the lipless end of the tubular member and secured by interference at the lipped end of the tubular member. The other end block portion also has two sections. For this end block, the smaller section is sized so that it fits into the open area at the lipless end of the tubular member, and the larger section is sized to not fit into this open area. The end block portions and the tubular member are joined by welding, and the surfaces at which they contact can have projections of triangular cross section that serve to direct welding energy.

In all embodiments, suitable methods of attaching the fusible element to the terminals include spot welding and ultrasonic welding. The fusible element is preferably corrugated and attached to the long sides of the terminals. It should be understood that multiple fusible elements can be used.

Preferably, the housing contains arc-quenching fill, in particular a solid fill.

Other advantages and features of the invention will be apparent from the following description of particular embodiments thereof and from the claims.

DESCRIPTION OF PARTICULAR EMBODIMENTS

Particular embodiments of the invention will now be described.

DRAWINGS

STRUCTURE, MANUFACTURE, AND OPERATION

Figure 1:
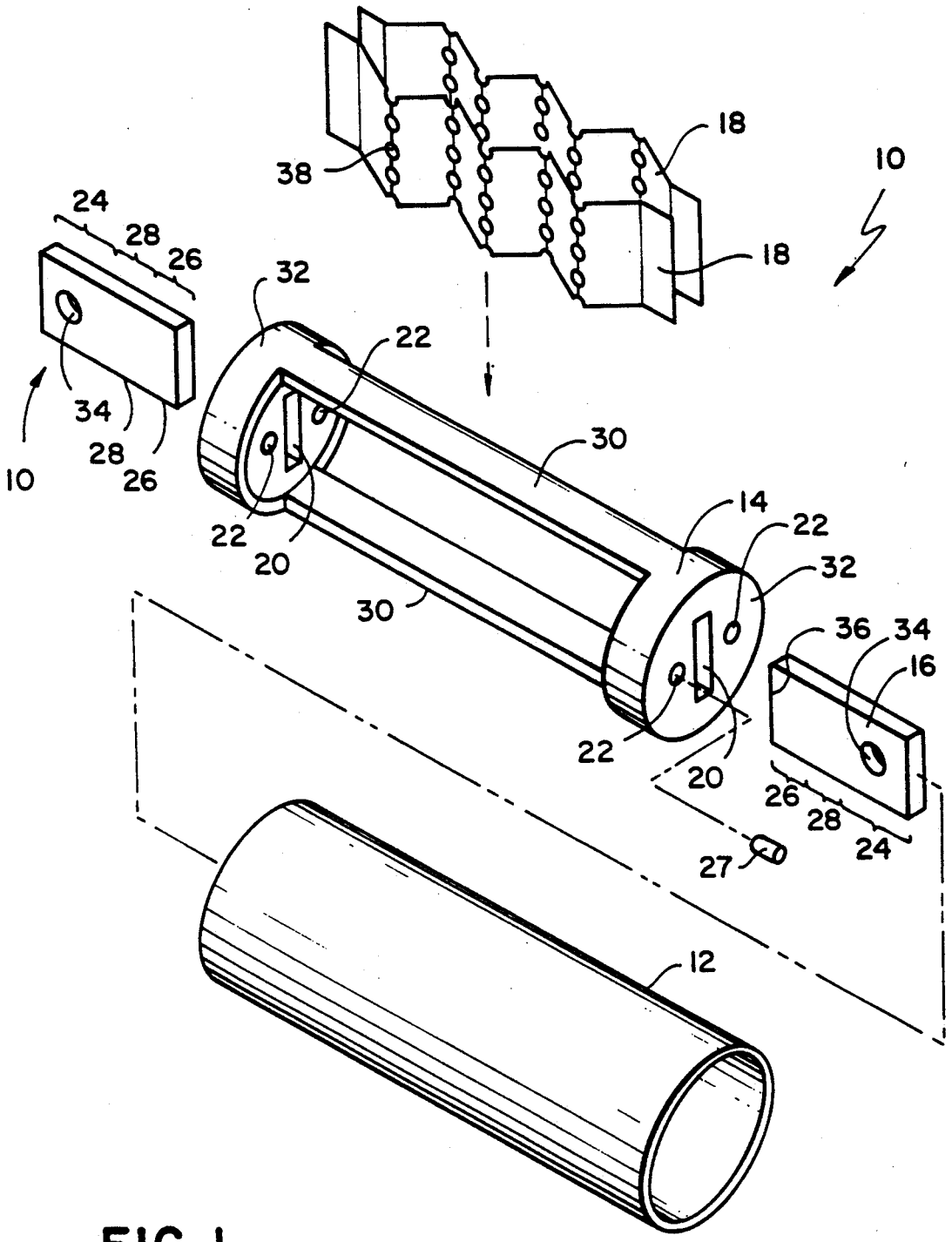
FIG. 1 is an exploded perspective view of a fuse according to the invention.
Figure 2:
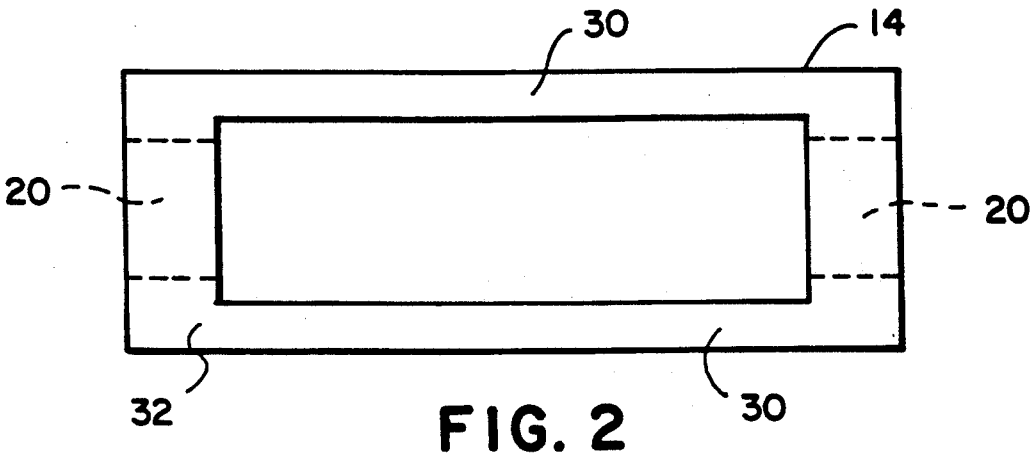
FIG. 2 is a side view of the spanner/end block assembly of the FIG. 1 fuse.
Figure 3:
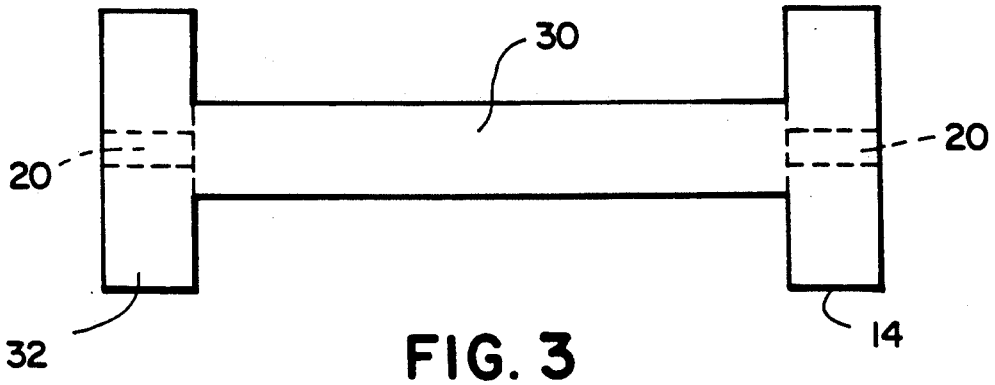
FIG. 3 is a top view of the FIG. 2 spanner/end block assembly.

Referring to FIGS. 1-3, fuse 10 includes tubular member 12 made of insulative material, spanner/end block assembly 14, consisting of spanners 30 and end block portions 32 and made of insulative material, terminals 16 made of conducting material, and fusible elements 18 made of conducting material. Spanner/end block assembly 14 is sized to fit within tubular member 12, and includes slots 20 and fill holes 22 located on opposite ends of spanner/end block assembly 14. Terminals 16 include external portions 24, internal portions 26, and middle portions 28. External portions 24 have holes 34. Fusible elements 18 are attached to opposite surfaces 36 of internal portions 26. Fusible elements 18 have current limiting notch sections 38 defined by rows of holes and are generally corrugated to provide a relatively larger number of notch sections 38 for a given length of housing than would be permitted if fusible elements 18 were straight.

In manufacture, the ends of fusible elements 18 are attached to surfaces 36 by resistance (spot or continuous) welding or ultrasonic welding, and terminals 16 (with elements 18 attached therebetween) are insert molded within spanner/end block assembly 14 during molding of assembly 14. Alternatively, terminals 16 could be held in place in spanner/end block assembly 14 by welding that would cause melting and reflow of the plastic material of the end block portion; e.g., ultrasonic welding could be employed. The subassembly of terminals 16, attached fusible elements 18, and spanner/end block assembly 14 is then inserted in tubular member 12 and joined to tubular member 12.

When tubular member 12 and spanner/end block assembly 14 are made of thermoplastic material, they can be joined together by ultrasonic welding. During such welding, one piece is held fixed, while the other is vibrated at 20 KHz and moved toward the first, causing frictional heating and melting. The thermoplastic material has the capability to be melted and reformed while retaining its properties when cooled below its melt point; this is desirable to permit joinder of preformed housing pieces by welding and to avoid the use of adhesives. The material should also have a sufficiently high continuous use temperature so as to maintain structural integrity at elevated temperatures resulting from heating when operating at rated current conditions. Preferably the continuous use temperature (UL746C, 100,000 hour test) is greater than 120° C. Fillers are preferably added to the thermoplastic resins to reduce the cost of the material and to improve the mechanical properties of the plastic by forming a support matrix within the plastic. Fillers tend to increase the continuous use temperature of the thermoplastic material, thereby providing improved structural integrity at elevated temperatures. However, depending on the resin and filler material, increasing filler concentration beyond a certain amount tends to reduce the strength; also, increasing the concentration beyond a certain amount may tend to negatively affect the ability to create strong bonds using ultrasonic welding. It accordingly is desirable to increase the continuous use temperature as much as possible while still achieving good bond strength using ultrasonic welding. Suitable filler materials include fiber glass, calcium carbonate, carbon fiber, cellulose, and graphite fiber. In general, thermoplastic materials with a continuous use temperature above 120° C. and a filler concentration between 20% and 40% (most preferably between 30% and 35%) provide necessary strength at elevated temperature while still permitting processing by ultrasonic welding. The thermoplastic material also preferably includes a flame retardant, is nontoxic (not give off toxins when at elevated temperature), and has high dielectric strength (above 400 volts/mil).

A suitable material for the thermoplastic material is glass reinforced polyphthalamide semicrystalline resin containing 33% glass filler available under the Amodel AF-133 VO trade designation from Amoco Performance Products, Inc., Atlanta, GA. This material includes a flame retardant and has a continuous use temperature of 125° C. per UL746C.

Other suitable materials include a highly crystalline Nylon 4.6, having 30% glass filler, and available from DSM Corp. under the Stanyl trade designation; polyphenylene sulfide having 30% glass filler and available from Phillips Corp. under the Ryton trade designation; and glass-filled liquid crystal polymers such as Xydar from Amoco, Supec from General Electric, and Vectra from Hoechst Celanese.

Another technique for joining tubular member 12 and spanner/end block assembly 14 together is by adhesive bonding, e.g., when the material is thermoset or thermoplastic material.

After tubular member 12 and spanner/end block assembly 14 are bonded together, the resulting void space in tubular member 12 is filled with a granular arc-quenching fill material (e.g., 50/70 or 40/60 quartz; not shown) through fill holes 22 located in end block portions 32. When the fuse employs a solid fill, sodium silicate binder solution is introduced through a hole 22 and coats the quartz granules. After the binder solution is cured, fill holes 22 are then sealed with preformed metal plugs 27 or non-conductive potting.

Figure 4:
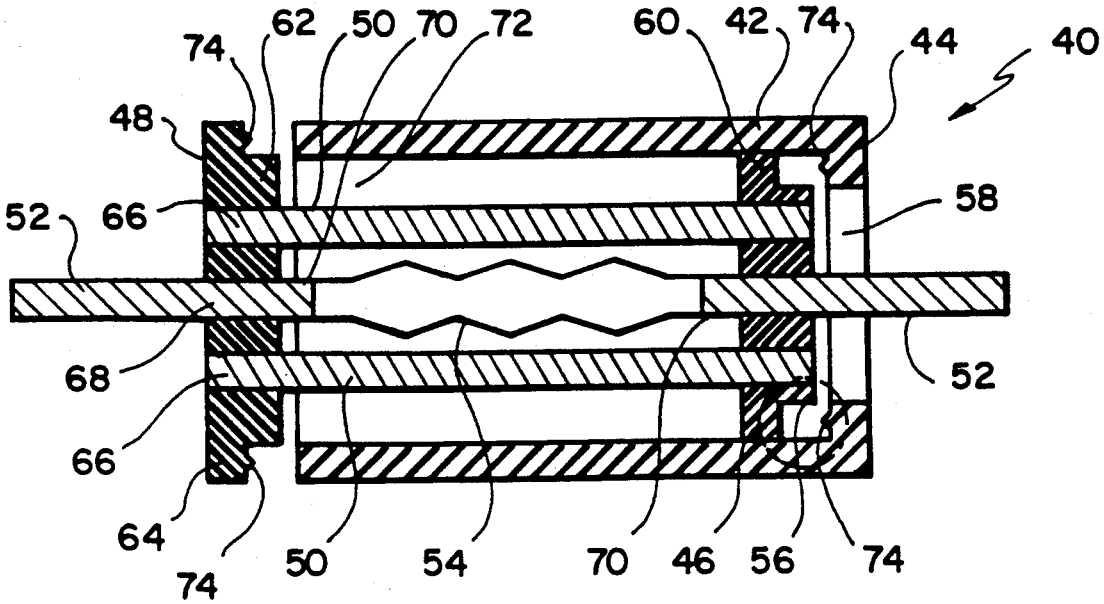
FIG. 4 is a sectional view of a fuse according to an alternative embodiment of the invention.

Referring to FIG. 4, fuse 40, an alternative embodiment of the invention, includes tubular member 42 made of insulative material and having lip 44, end blocks 46, 48 made of insulative material, spanners 50 preferably made of metal (though other materials can be used), terminals 52 made of conducting material, and fusible elements 54 made of conducting material. End block 46 has an exterior section 56, sized to fit within an area 58 defined by lip 44, and an interior section 60 sized to be larger than area 58 and to fit within the interior of tubular member 42. End block 48 has an interior section 62, sized to fit within the interior of tubular member 42, and an exterior section 64, sized to be larger than the interior of tubular member 42.

In manufacture, spanners 50 are connected to end blocks 46, 48 at holes 66. Holes 66 are sized to hold spanners 50 in place by an interference fit; alternatively, spanners 50 could be affixed by ultrasonic or other welding or other means. The spanners could also be provided with shoulders to prevent slippage of the spanners relative to an end block during attachment of the end block to the tubular member. Terminals 52 are inserted into end blocks 46, 48 through slots 68, and fusible elements 54 are attached to opposite surfaces 70 of terminals 52. (Alternatively, the fusible elements could be attached to the terminals first, and the end blocks could be insert molded with the terminals and spanners in place.) Next, the terminal/end block/spanner assembly is inserted into tubular member 42 via open end 72 until interior section 60 of end block 46 contacts lip 44. The terminal/end block/spanner assembly is attached to tubular member 42 using ultrasonic welding. To facilitate the welding process, exterior section 64 of end block 48 and lip 44 can have triangular cross section projections 74 that serve to direct welding energy. The spanners may or may not be removed after the end blocks have been secured to tubular member 42; if they are removed, the holes could be used for introducing fill material.

Other embodiments of the invention are within the scope of the following claims. E.g., in addition to circular cross section tubes, other shapes such as squares and hexagons can be used for tubular member 12. Also, other techniques can be used to secure end block portions to tubular casings; e.g,, pins through the casing and end blocks, internal C-rings, external rings, fingers and detents.

What is claimed is:

1. A fuse comprising a tubular member made of insulative material and having two open ends;

end block portions made of insulative material and located at each of said two ends of said tubular member, each of said end block portions having an opening therethrough;

a spanner joining together said end block portions;

said spanner being directly attached to said block portions;

terminals extending through both of said openings, each of said terminals having an internal portion inside said tubular member, an external portion outside of said tubular member, and a middle portion between said internal and external portions and located within one of said openings; and said terminals being spaced from said spanner; and a fusible element having ends connected to respective internal portions of both of said terminals.

2. The fuse of claim 1 wherein said end block portions and said spanner comprise a single housing piece.

3. The fuse of claim 2 wherein said single housing piece is made of plastic.

4. The fuse of claim 1 wherein said spanner and said end block portions comprise separate housing pieces.

5. The fuse of claim 3 wherein said single housing piece further comprises a second spanner joining together said end portions.

6. The fuse of claim 4 further comprising a second spanner joining together said end block portions, and wherein each of said spanners is a separate housing piece.

7. The fuse of claim 1 wherein said spanner has an outside surface, said tubular member has an inside surface, and said outside surface of said spanner abuts said inside surface of said tubular member.

8. The fuse of claim 1 wherein said tubular member is cylindrical, and said end block portions are circular.

9. The fuse of claim 1 wherein said spanner is made of metal.

10. The fuse of claim 1 wherein said end block portions are insert molded around said terminals.

11. The fuse of claim 1 wherein each of said terminals are retained in one of said end block portions by a pin between the terminal and respective end block portion.

12. The fuse of claim 1 wherein said tubular member and said end block portions are ultrasonically welded to each other.

13. The fuse of claim 1 wherein a first of said open ends of said tubular member has a lip, whereby a first open area at said first open end of said tubular member is smaller than a second open area at a second open end of said tubular member; and one of said end block portions has a first section and a second section, said first section having a cross sectional area smaller than said first open area, and said second section has a cross sectional area larger than said first open area and smaller than said second open area, wherein said one end block portion is inserted in said second open end of said tubular member and maintained in said first open end of said tubular member by interference.

14. The fuse of claim 13 wherein said one end block portion and said tubular member are joined by welding, said lip has an interior surface inside said tubular member, and said second section of said one end block portion has an exterior surface, said interior surface of said lip contacting said exterior surface of said second section when said one end block portion and said tubular member are joined, at least one of said interior surface of said lip and said exterior surface of said second section has a portion that include a projection, said projection having a triangular cross-section, at least one of said interior surface of said lip and said exterior surface of said second section has a portion that is essentially flat, said flat portion and said projection are so arranged that, when said one end block portion and said tubular member are joined, said projection contacts said flat portion.

15. The fuse of claim 1 wherein one of said end block portions has a first section and a second section, said first section having a cross sectional area smaller than the open area of one of said open ends of said tubular member, and said second section has a cross sectional area larger than the open area of both of said open ends of said tubular member, wherein said one end block portion is maintained at said one open end of said tubular member by interference.

16. The fuse of claim 15 wherein said one end block portion and said tubular member are joined by welding, said one open end of said tubular member has an exterior surface and said second section of said one end block portion has an interior surface, said exterior surface of said one open end contacting said interior surface of said second section when said one end block portion and said tubular member are joined, at least one of said exterior surface of said one open end and said interior surface of said second section has a portion that include a projection, said projection having a triangular cross-section, at least one of said exterior surface of said one open end and said interior surface of said second section has a portion that is essentially flat, said flat portion and said projection are so arranged that, when said one end block portion and said tubular member are joined, said projection contacts said flat portion.

17. The fuse of claim 1 wherein said tubular member and said end block portion are made of thermoplastic material and are welded to each other.

18. The fuse of claim 17 wherein said thermoplastic material has a continuous use temperature greater than 120° C.

19. The fuse of claim 18 thermoplastic material includes a filler.

20. The fuse of claim 19 wherein said thermoplastic material has between 20% and 40% filler.

21. The fuse of claim 20 wherein said thermoplastic material has between 30% and 35% filler.

22. The fuse of claim 20 wherein said thermoplastic material comprises highly crystalline Nylon 4.6.

23. The fuse of claim 20 wherein said thermoplastic material comprises polyphthalamide.

24. The fuse of claim 20 wherein said thermoplastic material comprises polyphenylene sulfide.

25. The fuse of claim 20 wherein said thermoplastic material comprises liquid crystal polymer.

26. The fuse of claim 1 wherein said tubular member contains arc-quenching fill.

27. The fuse of claim 1 wherein said fusible element is spot welded to said internal portions of said terminals.

28. The fuse of claim 1 wherein said fusible element is ultrasonically welded to said internal portions of said terminals.

29. The fuse of claim 1 wherein each of said internal portions of said terminals has two long surfaces, two short surfaces, and an end surface, and said fusible element is connected to one of said long surfaces of said internal portions of each of said terminals.

30. The fuse of claim 1 wherein said fusible element is corrugated.

31. The fuse of claim 1 wherein said housing contains arc-quenching fill.

32. The fuse of claim 1 further comprising a plurality of fusible elements having ends connected to respective internal portions of both of said terminals.

* * * * *